US005374199A

United States Patent [19]

Chung

[11] Patent Number: 5,374,199

[45] Date of Patent: Dec. 20, 1994

[54] SAFETY RECEPTACLE

[76] Inventor: Chien-Lin Chung, c/o Hung Hsing Patent Service Center, P.O. Box 55-1670, Taipei (10477), Taiwan, Prov. of China

[21] Appl. No.: 99,456

[22] Filed: Jul. 30, 1993

[51] Int. Cl.[5] ..... H01R 13/703

[52] U.S. Cl. ..... 439/188; 200/51.09

[58] Field of Search ..... 439/188; 200/51.09, 200/51.1

[56] References Cited

U.S. PATENT DOCUMENTS 3,596,019 7/1971 Koester ..... 200/51.09
3,980,370 9/1976 Gonzalez-Hernandez ..... 200/51.09
5,112,237 5/1992 Yang ..... 439/188

*Primary Examiner*—Neil Abrams

[57] ABSTRACT

A safety receptacle includes: a safety tripping device resiliently mounted in a receptacle housing and operatively depressible by an electric plug pin to electrically contact a clip of two clips respectively mounted in two cavities in the housing, with a positive terminal plate of a power source for connecting the power source for output use, and upon a release of the electric plug from the receptacle, the safety tripping device will be restored resiliently to always separate the clip from the positive terminal plate of the power source to disconnect the power source to any external object accidentally inserted into a pin hole formed in the receptacle housing for safety purpose.

4 Claims, 5 Drawing Sheets 121
12
122

61
62
6
5
4
3
1
113
11
115
111
63
112
2

SAFETY RECEPTACLE

BACKGROUND OF THE INVENTION

A conventional electrical receptacle or wall socket may be incidentally inserted therein with electrically conductive sticks, wires or external objects by a child to cause electric shock or even injury to a child especially when a kid of small age is uncarefully taken care by a mother or baby sitter.

Even a wall socket may also be provided with a power switch thereon, such a power switch can be normally switched off for safety purpose, and will be switched on only for connecting the power supply source from the socket. However a child may still push the button to actuate the power switch and may insert an electrically conductive rod into the socket to cause dangerous electric shock or hazard to the innocent child.

It is therefore expected to disclose a safety receptacle which is normally locked for safety purpose.

SUMMARY OF THE INVENTION

The object of the present invention is to provide a safety receptacle including: a safety tripping device resiliently mounted in a receptacle housing and operatively depressible by an electric plug pin to electrically contact a clip of two clips respectively mounted in two cavities in the housing, with a positive terminal plate of a power source for connecting the power source for output use, and upon a release of the electric plug from the receptacle, the safety tripping device will be restored resiliently to always separate the clip from the positive terminal plate of the power source to disconnect the power source to any external object accidentally inserted into a pin hole formed in the receptacle housing for safety purpose.

DETAILED DESCRIPTION

Figure 1:
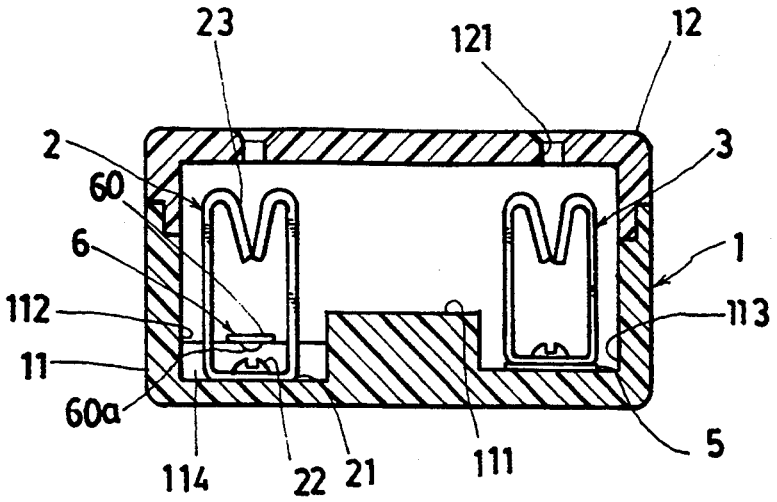
FIG. 1 is a sectional drawing of the present invention.
Figure 2:
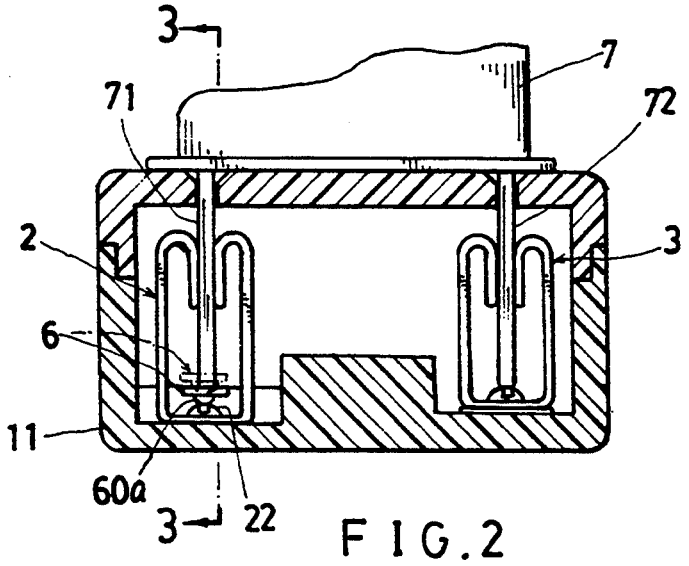
FIG. 2 is a sectional drawing of the present invention when plugged with an electric plug.
Figure 3:
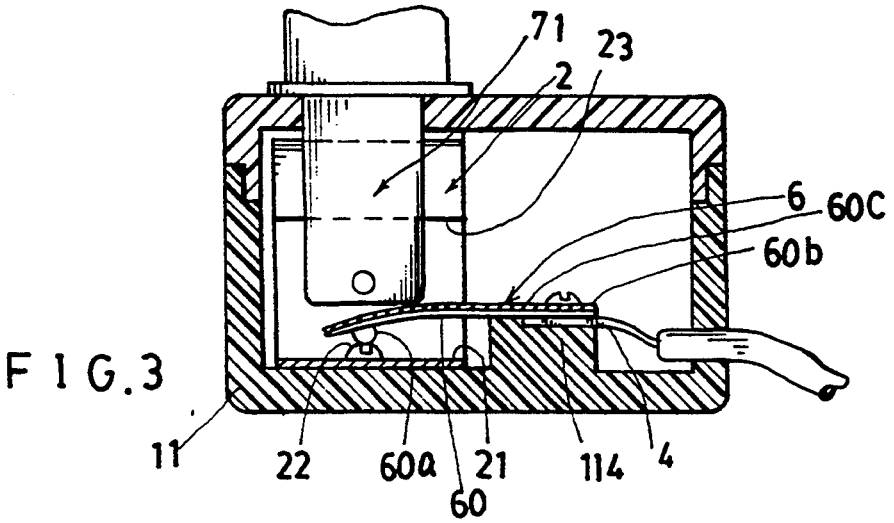
FIG. 3 is a partial sectional drawing of the present invention when viewed from 3—3 direction of FIG. 2.

As shown in FIGS. 1–3, the present invention comprises: a housing 1, a first clip member 2 mounted in the housing 1 and connectable to a first terminal plate 4 of a first pole (or positive pole) of a power source, a second clip member 3 mounted in the housing 1 and connected to a second terminal plate 5 of a second pole (or negative pole) of the power source, and a safety tripping means 6 resiliently provided in the housing 1 operatively depressed by an electric plug 7 for power connection purpose.

The housing 1 includes: a lower housing portion 11 having a central partition portion 111 separating a first cavity 112 and a second cavity 113 disposed on two opposite sides of the central partition portion 111 for respectively mounting the first and second clip members 2, 3 in the two cavities 112, 113; and a cover 12 shielding the lower housing portion 11 having two pin holes 121 formed in the cover 12 to be plugged in by two pins 71, 72 of an electric plug 7.

The first clip member 2 includes: a base clip portion 21 secured in the cavity 112 of the housing 1 by a screw having a screw head formed as a clip contactor protrusion 22 which is electrically conductive and electrically connected with the first clip member 2, and an upper clamping portion 23 for clamping any pin 71 or 72 of the electric plug 7.

The second clip member 3 is similar to the first clip member 2 provided for clamping the pin 71 or 72 of the plug 7. The second clip member 3 is normally connected to a second or negative pole of the power source.

The safety tripping means 6 includes: a resilient contactor lever 60 made of elastic and electrically conductive material and having an upper surface **60*c* of the lever coated with an electrically insulative layer, having a lever contactor protrusion 60*a* formed on a bottom of the lever 60 operatively lowered to contact a clip contactor protrusion 22 formed on the first clip member 2, and having a fixing end portion 60*b* secured on a supporting base 114 in the housing 1 and connected with a first terminal plate 4 connected to a first pole or positive pole of a power source, whereby upon an inward depression of a pin 71 of an electric plug 7 through the pin hole 121 in the cover 12 to downwardly bias the resilient contactor lever 60 to contact the clip contactor protrusion 22 of the first clip member 2, an electrical connection among the first clip member 2, the resilient contactor lever 60 and the first terminal plate 4 will be connected for connecting the power source to the electric plug 7; and whereby upon a releasing of the electric plug 7 from the housing 1 of the receptacle, the resilient contactor lever 60 will be automatically restored by its self elasticity to separate from the clip contactor protrusion 22 and the first clip member 2** for safety purpose.

The insulative upper surface layer **60*c* on the lever 60 may prevent an electric shock caused by an insertion of conductive material through the hole 121 to contact the lever 60 even made of electrically conductive material under the upper surface layer 60*c***.

Figure 4:
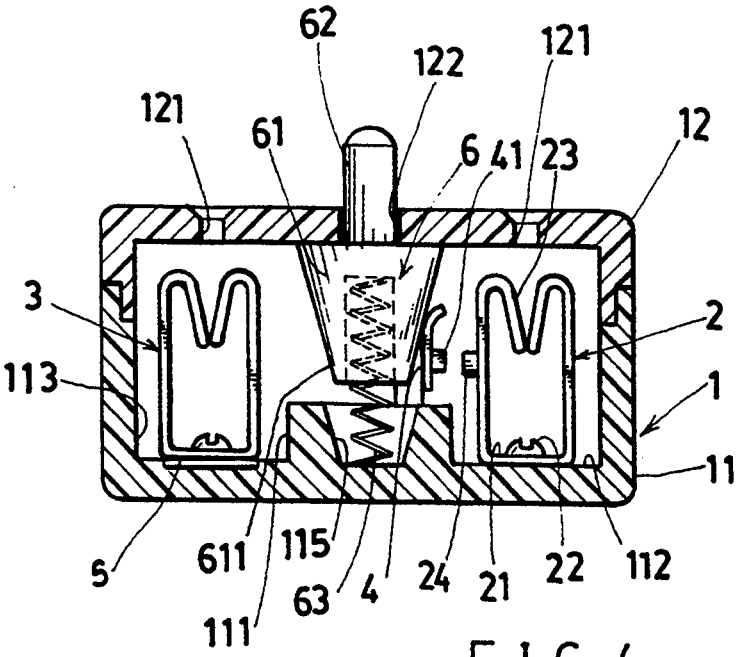
FIG. 4 is a sectional drawing of another preferred embodiment.
Figure 5:
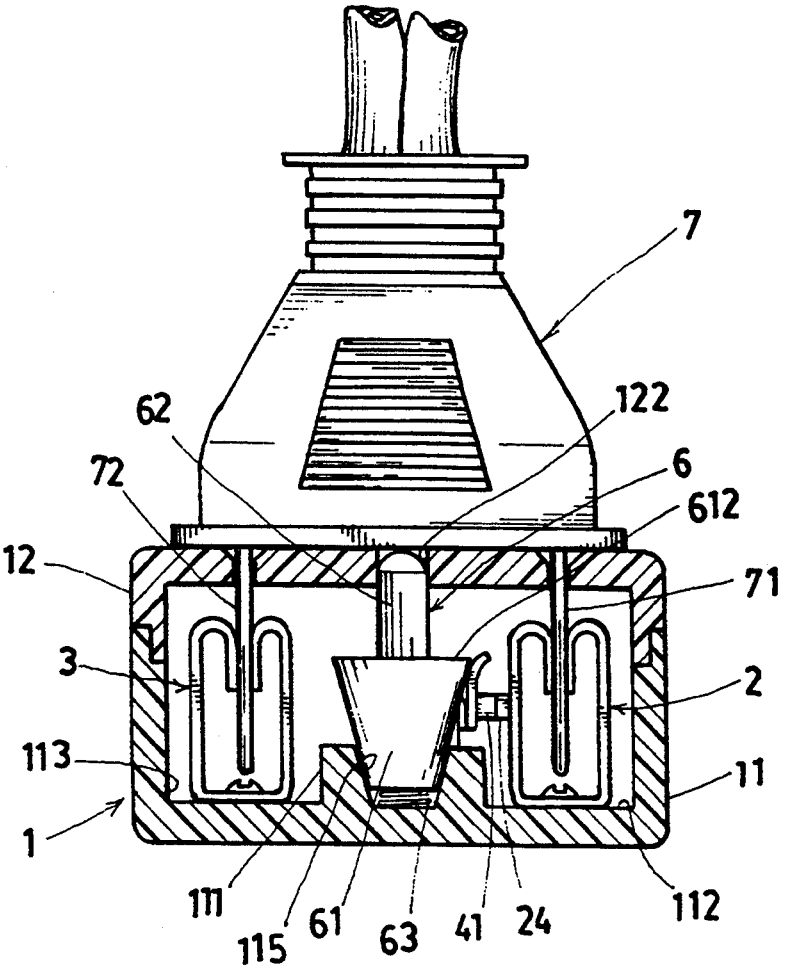
FIG. 5 is an illustration when plugged in by an electric plug into the receptacle of FIG. 4.
Figure 6:
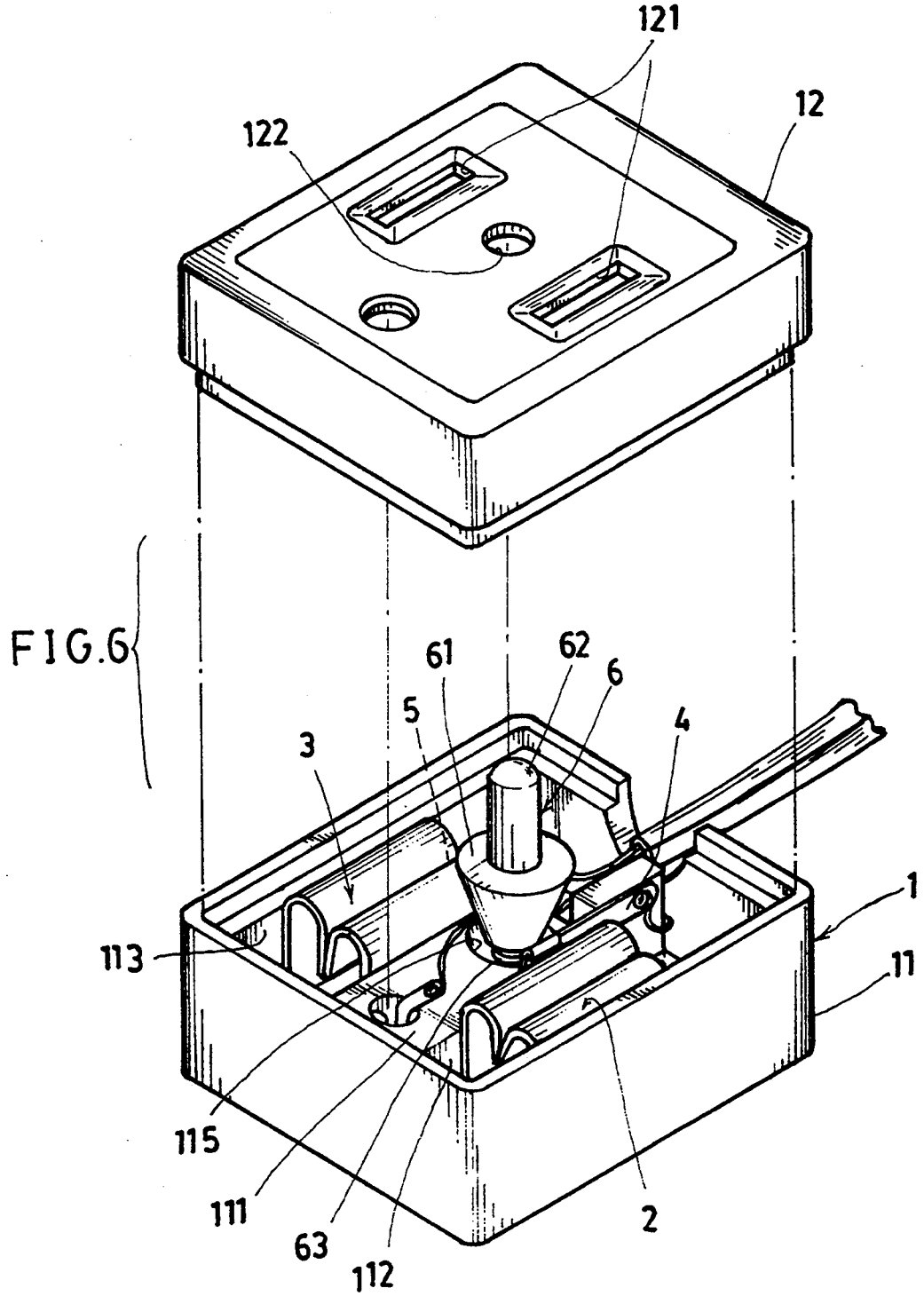
FIG. 6 is a perspective view of the receptacle of the present invention as shown in FIG. 4.

As shown in FIGS. 4–6, the safety tripping means 6 is modified to include: a plunger 61 conically shaped and tapered downwardly to have a lower taper portion 611 and an upper enlarged portion 612 (having a diameter larger than that of the lower taper portion 611) positioned under the cover 12 of the housing 1, a button stem 62 made of electrically insulative material and protruding upwardly from the plunger 61 through a button hole 122 formed through the cover 12, and a restoring spring 63 retained between the plunger 61 and a plunger socket 115 recessed in a central partition portion 111 for normally urging the plunger 61 and the button stem 62 upwardly to protrude the button stem 62 upwardly beyond the cover 12 of the housing 1 adapted to be depressed by a plug 7 and to allow a first terminal plate 4 which is connected to a first or positive pole of a power source to be normally separated from the first clip member 2 since the terminal plate 4 is resiliently restored to approach the lower taper portion 611 of the plunger 61; and upon a downward depression by a plug 7, the plunger 61 with its upper enlarged portion 612 will operatively thrust a first terminal plate 4 laterally or sidewardly to contact the first clip member 2 for electrically connecting a first or positive pole of the power source with the first clip member 2 and the pin 71 of the plug 7; and whereby upon a removal of the plug pin 71 from the housing 1 of the receptacle, the plunger 61 will be upwardly restored by the restoring spring 63 to recover the first terminal plate 4 to separate from the first clip member 2 for safety purpose.

The first clip member 4 has a side contactor protrusion 24 formed on a side portion of the clip member 4 to be operatively contacted with a terminal contactor protrusion 41 formed on the first terminal plate 4.

Even an insertion of a conductive rod or wire by an innocent kid into the receptacle, the clip 2 is not connectable to the first pole of power source so that an electric shock will not be caused to injure the kid for ensuring safety of the present invention.

Figure 7:
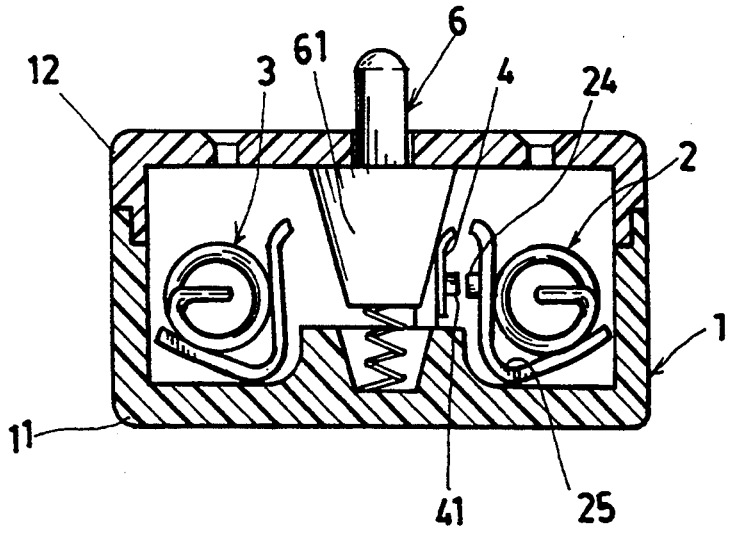
FIG. 7 shows still another preferred embodiment modified from FIG. 4.

As shown in FIG. 7, any clip member 2 or 3 may be formed as a spring coil made of electrically conductive which is secured to a contactor plate 25 having a cross section of generally L shaped and having a side contactor protrusion 24 to be electrically connected with a terminal contactor protrusion 41 of a first terminal plate 4 of a first or positive pole of a power source, whereby upon a downward depression of the plunger 61 of the safety tripping means 6, the first terminal plate 4 will be biased sidewardly to contact the first clip member 2 for an electrical connection between the first or positive pole of the power source to the clip member 2 which is connectable to a plug pin 71 or 72 of a plug 7. The operation or function of this embodiment is similar to that of FIG. 4.

Figure 8:
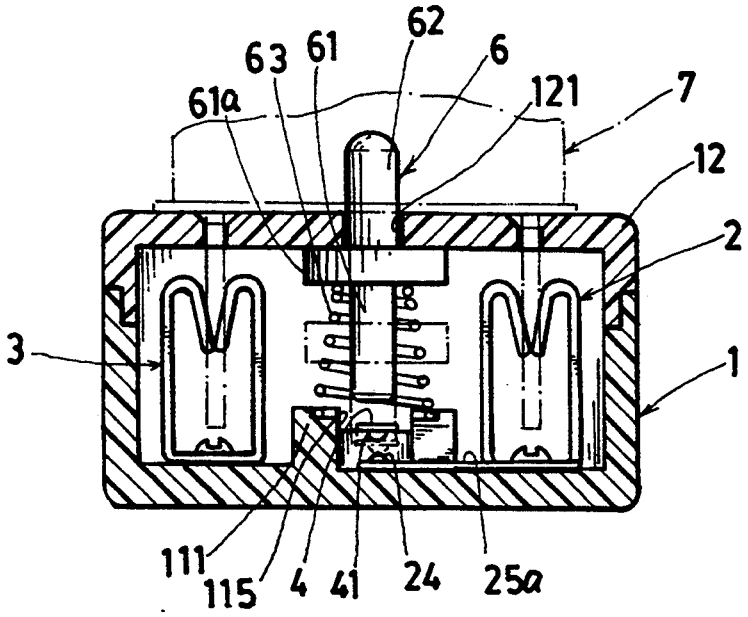
FIG. 8 shows further preferred embodiment of the present invention.

As shown in FIG. 8, the safety tripping means 6 is modified to include: a plunger 61 generally cylindrical shaped and secured with a disk 61*a* which is upwardly tensioned by a restoring spring 63 retained on the central partition portion 111 of the housing 1, a button stem 62 made of electrically insulative material and protruding upwardly from the disk 61*a*, the disk 61*a* being urged upwardly by the restoring spring 63 to normally protrude the button stem 62 upwardly beyond a button hole 121 formed in the cover 12 of the housing 1 to be depressed by the electric plug 7, the plunger 61 operatively acting upon a first terminal plate 4, which is resiliently held in the plunger socket 115 connected to a first or positive pole of the power source, to contact a horizontal contactor plate 25*a* electrically connected to the first clip member 2 so as to have an electrical connection between the power source and a plug pin 71 or 72 of an electrical plug 7 when plugged in the housing 1 of the receptacle of the present invention. When the plug 7 is removed, the spring 63 will restored the plunger 61 upwardly to restore the terminal plate 4 horizontally to disconnect the power source.

Figure 9:
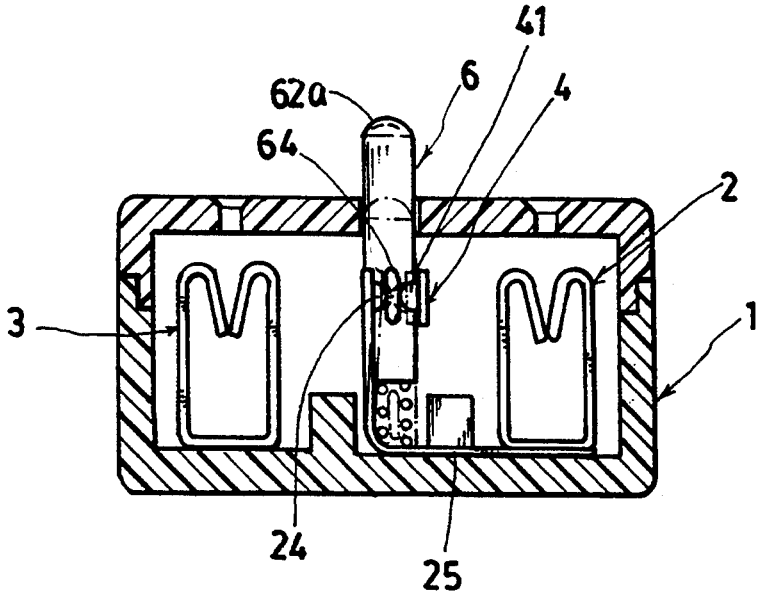
FIG. 9 shows still further preferred embodiment of the present invention.
Figure 10:
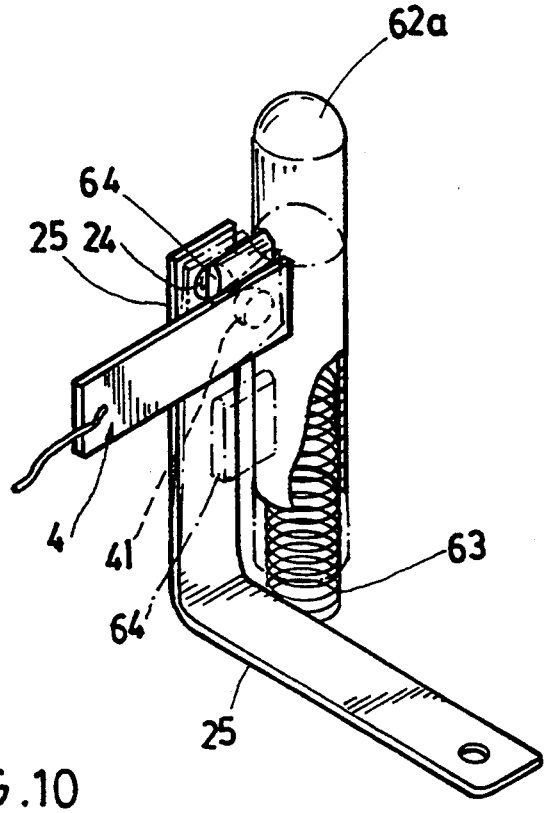
FIG. 10 is a partial perspective view shows some relevant parts of the present invention of FIG. 9.

As shown in FIGS. 9 and 10, the safety tripping means 6 of the present invention is modified to include: a button plunger 62*a* generally cylindrical shaped and normally urged upwardly by a restoring spring 63 retained on the lower housing portion 11 of the receptacle, having a blade member 64 longitudinally secured to a side portion of the button plunger 62*a*, said plunger 62*a* and the blade member 64 being made of electrically insulative material, said blade member 64 normally separating a first terminal plate 4 (at contactor protrusion 41) which is connected to a first or positive pole of a power source and a contactor plate 25 (at contactor protrusion 24) generally L shaped and connected to the first clip member 2 for safety purpose; and upon a depression of the button plunger 62*a* to lower the blade member 64 to allow the first terminal plate 4 to resiliently contact the contactor plate 25 by a self elasticity thereof to electrically connect the first or positive pole of the power source, the contactor plate 25, the first clip member 2 and a plug pin 71 or 72 plugged in the receptacle.

The first terminal plate 4 and the contactor plate 25 may be made as bi-metal which are thermally separable to disconnect the power, when subjected to a high rise of temperature such as overload of an electric appliance having a plug 7 inserted in the housing 1 of the receptacle, thereby enhancing safety protection.

Upon a removal of the plug 7, the button plunger 62*a* will be restored by the spring 63 to raise the blade member 64 to be disposed in between the terminal plate 4 and the contactor plate 25 to further separate the two contactor protrusions 41, 24 respectively secured to the terminal plate 4 and the contactor plate 25 which is secured with the clip member 2.

The present invention provides a reliable safety measure of an electric receptacle which is normally "locked" since at least one clip member is always disconnected to a power source terminal, unless the receptacle is "alive" by plugging the pins 71, 72 of an electric plug 7 into the holes 121 of the receptacle housing to contact the two clip members 2, 3 to "unlock" the safety tripping means 62 of this invention. It is therefore safe especially for preventing a kid's incidental insertion of conductive rod, stick, or wire into the receptacle for enhancing electrical safety.

I claim:

1. A safety receptacle comprising:

a housing having a first clip member connectable to a first pole of a power source and a second clip member, both said first and said second clip members mounted in two opposite cavities in said housing;

said second clip member electrically connected to a second pole of the power source;

a safety tripping means resiliently held in said housing and normally separating said first clip member from the first pole of the power source, and operatively depressible, as depressed by an electric plug having two plug pins inserted in said housing for connecting said first and second clip members, to contact said first clip member with said first pole of said power source for connecting the power source to the plug, whereby upon a removal of said plug from said receptacle, said safety tripping means will be resiliently restored to separate said first clip member from said first pole of said power source for safety purpose;

said safety tripping means including: a resilient contactor lever made of elastic and electrically conductive material having a lever contactor protrusion formed on a bottom of the lever operatively depressible to contact a clip contactor protrusion formed on the first clip member, an electrically insulative layer coated on an upper surface of the lever, and having a fixing end portion of said lever secured on a supporting base in the housing and connected with a first terminal plate connected to the first pole of the power source, whereby upon an inward depression of a pin of the electric plug through the pin hole formed in a cover of the housing to downwardly bias the resilient contactor lever to allow said lever contactor protrusion of said lever to contact the clip contactor protrusion of the first clip member, an electrical connection among the first clip member, the resilient contactor lever and the first terminal plate will be connected for connecting the power source to the electric plug; and whereby upon a releasing of the electric plug from the housing of the receptacle, the resilient contactor lever will be automatically restored by its self elasticity to separate from the clip contactor protrusion and the first clip member for safety purpose.

2. A safety receptacle comprising:

a housing having a first clip member connectable to a first pole of a power source and a second clip member, both said first and said second clip members mounted in two opposite cavities in said housing;

said second clip member electrically connected to a second pole of the power source;

a safety tripping means resiliently held in said housing and normally separating said first clip member from the first pole of the power source, and operatively depressible, as depressed by an electric plug having two plug pins inserted in said housing for connecting said first and second clip members, to contact said first clip member with said first pole of said power source for connecting the power source to the plug, whereby upon a removal of said plug from said receptacle, said safety tripping means will be resiliently restored to separate said first clip member from said first pole of said power source for safety purpose;

said safety tripping means including: a plunger conically shaped and tapered downwardly to have a lower taper portion and an upper enlarged portion position under the cover of the housing with the upper enlarged portion having a diameter larger than that of the lower taper portion, a button stem made of electrically insulative material and protruding upwardly from the plunger through a button hole formed through a cover of said housing, and a restoring spring retained between the plunger and a plunger socket recessed in a central partition portion in the housing for normally urging the plunger and the button stem upwardly to protrude the button stem upwardly beyond the cover of the housing adapted to be depressed by the plug and to allow a first terminal plate connected to the first pole of the power source to be restored to approach the lower taper portion of said plunger to be normally separated from the first clip member; and upon a downward depression by the plug, the plunger with the upper enlarged portion of the plunger will operatively thrust the first terminal plate sidewardly to contact the first clip member for electrically connecting the first pole of the power source with the first clip member and the pin of the plug; and whereby upon a removal of the plug pin from the housing of the receptacle, the plunger will be upwardly restored by the restoring spring to recover the first terminal plate to separate from the first clip member for safety purpose; said first clip member having a side contactor protrusion formed on a side portion of the first clip member to be operatively contacted with a terminal contactor protrusion formed on the first terminal plate.

3. A safety receptacle according to claim 2, wherein each said clip member is formed with a spring coil made of electrically conductive material, said spring coil secured to a contactor plate having a cross section of generally L shaped and having a side contactor protrusion of the contactor plate electrically connectable to a terminal contactor protrusion formed on a first terminal plate connectable to the first pole of the power source, whereby upon a downward depression of the plunger of the safety tripping means, the first terminal plane will be biased sidewardly to contact the first clip member for an electrical connection between the first pole of the power source and the first clip member which is connectable to the plug pin.

4. A safety receptacle comprising:

a housing having a first clip member connectable to a first pole of a power source and a second clip member, both said first and said second clip members mounted in two opposite cavities in said housing;

said second clip member electrically connected to a second pole of the power source;

a safety tripping means resiliently held in said housing and normally separating said first clip member from the first pole of the power source, and operatively depressible, as depressed by an electric plug having two plug pins inserted in said housing for connecting said first and second clip members, to contact said first clip member with said first pole of said power source for connecting the power source to the plug, whereby upon a removal of said plug from said receptacle, said safety tripping means will be resiliently restored to separate said first clip member from said first pole of said power source for safety purpose;

said safety tripping means including: a button plunger generally cylindrical shaped and normally urged upwardly by a restoring spring retained on a lower housing portion of the housing, having a blade member longitudinally secured to a side portion of the button plunger, said plunger and the blade member being made of electrically insulative material, said blade member normally partitioning a first terminal plate connected to the first pole of the power source, and a contactor plate generally L shaped and connected to the first clip member when said plunger is upwardly restored by said restoring spring for disconnecting the power source for safety purpose; and upon a depression of the button plunger to lower the blade member to allow the first terminal plate to resiliently contact the contactor plate by a self elasticity thereof to electrically connect the first pole of the power source, the contactor plate, the first clip member and the plug pin plugged in the receptacle, said first terminal plate and the contactor plate being made as bi-metal which are thermally separable to disconnect the power source, when subjected to a high rise of temperature due to overload of an electric appliance having the plug inserted in the housing of the receptacle.

* * * * *